US008608024B2

(12) United States Patent
Giraud et al.

(10) Patent No.: US 8,608,024 B2
(45) Date of Patent: Dec. 17, 2013

(54) DISPENSER HAVING INTERNAL SPRING ACTUATION

(75) Inventors: Jean-Pierre Giraud, Auburn, AL (US); Michel Zbirka, Jouy sur Morin (FR)

(73) Assignee: CSP Technologies, Inc., Norristown, PA (US)

( * ) Notice: Subject to any disclaimer, the term of this patent is extended or adjusted under 35 U.S.C. 154(b) by 586 days.

(21) Appl. No.: 12/993,376

(22) PCT Filed: Dec. 10, 2008

(86) PCT No.: PCT/US2008/086200

§ 371 (c)(1),
(2), (4) Date: Nov. 18, 2010

(87) PCT Pub. No.: WO2009/076421

PCT Pub. Date: Jun. 18, 2009

(65) Prior Publication Data

US 2011/0108567 A1 May 12, 2011

Related U.S. Application Data

(60) Provisional application No. 61/013,185, filed on Dec. 12, 2007.

(51) Int. Cl.

| | |
|---|---|
| ***B65H 3/00*** | (2006.01) |
| ***A47K 10/24*** | (2006.01) |
| ***B65H 1/00*** | (2006.01) |

(52) U.S. Cl.

USPC ..... 221/263; 221/261; 221/267; 221/289; 221/265; 221/268; 221/264; 221/256; 221/276; 221/44; 221/45; 221/49; 134/93; 134/100.1; 68/17 R

(58) Field of Classification Search

CPC ..... B65H 3/00; B65H 1/00; A47K 10/24
USPC ..... 221/261, 267, 263, 289, 265, 268, 264, 221/256, 276, 44, 45, 49; 134/93, 100.1; 68/17 R

See application file for complete search history.

(56) References Cited

U.S. PATENT DOCUMENTS

| | | | | |
|---|---|---|---|---|
| 3,896,967 | A * | 7/1975 | Doolittle | 221/95 |
| 6,726,058 | B2 * | 4/2004 | Giraud | 221/267 |

(Continued)

FOREIGN PATENT DOCUMENTS

| | | | | |
|---|---|---|---|---|
| GB | DE8501053 | U1 | | 9/1985 |
| JP | 09249272 | A | | 9/1997 |
| JP | 09249272 | A | * | 9/1997 |
| WO | WO2004/000703 | A | | 12/2003 |

OTHER PUBLICATIONS

State Intellectual Property Office of the People's Republic of China, Notification of First Office Action, in Application No. 200880120323.7, dated Jan. 29, 2012.

(Continued)

*Primary Examiner* — Timothy Waggoner
*Assistant Examiner* — Rakesh Kumar
(74) *Attorney, Agent, or Firm* — McAndrews, Held & Malloy, Ltd.

(57) ABSTRACT

A dispenser (10) is disclosed for dispensing a single object (22, 24) at a time, such as a tablet or the like. The dispenser includes a reservoir (26) to contain tablets and an opening in the reservoir sized to pass the tablets. A chute (30) is defined by a wall adjacent to the opening in the reservoir, and defines a dispensing path (39). The movable dispensing guide (32) has a retracted position that does not prevent the advance of tablets along the dispensing path, and an advanced position that intersects the dispensing path between the first and second tablets (22, 24) in the dispensing path. When advanced, the movable dispensing guide allows the first tablet in line to be dispensed from the path, and prevents the second tablet in line from advancing. An actuator is operable to move the movable dispensing guide from its retracted position to its advanced position.

19 Claims, 9 Drawing Sheets

(56) References Cited

U.S. PATENT DOCUMENTS

| | | | | |
|---|---|---|---|---|
| 6,889,869 | B2 * | 5/2005 | Hallin | 221/223 |
| 7,063,234 | B2 * | 6/2006 | Giraud | 221/271 |
| 7,172,503 | B2 * | 2/2007 | Umeda | 453/29 |
| 7,216,776 | B2 * | 5/2007 | Gelardi | 221/256 |
| 7,243,817 | B2 * | 7/2007 | Giraud | 221/263 |
| 7,472,710 | B2 * | 1/2009 | Jowett et al. | 134/93 |
| 7,533,785 | B2 * | 5/2009 | Smith et al. | 221/263 |
| 7,559,436 | B2 * | 7/2009 | Bieger | 221/256 |
| 7,988,016 | B2 * | 8/2011 | Klein et al. | 221/263 |
| 8,459,498 | B2 * | 6/2013 | Giraud | 221/251 |
| 2012/0012604 | A1 * | 1/2012 | Pfister et al. | 221/1 |

OTHER PUBLICATIONS

Notification of Transmittal of the International Search Report and The Written Opinion of the International Searching Authority, in PCT/US08/086200, dated Mar. 25, 2009.

Notification Concerning Transmittal of International Preliminary Report on Patentability, in PCT/US08/086200, dated Jan. 27, 2011.

European Patent Office, Communication pursuant to Article94(3) EPC, in Application No. 08 858 739.9-2308, dated Nov. 14, 2011.

* cited by examiner

DISPENSER HAVING INTERNAL SPRING ACTUATION

RELATED APPLICATION

This application is a 371 National Phase filing of International Patent Application Serial No. PCT/US2008/086200 filed Dec. 10, 2008, which claims priority to U.S. Patent Application Ser. No. 61/013,185 filed Dec. 12, 2007. The above applications are incorporated herein by reference in their entirety.

CROSS-REFERENCE TO RELATED APPLICATION

The priority of U.S. Ser. No. 61/013,185, filed Dec. 12, 2007, is claimed. That specification is incorporated by reference.

BACKGROUND OF THE INVENTION

The present invention relates to a dispenser for tablets, capsules, or other objects that dispenses the objects one at a time from a supply, as demanded by the user.

BRIEF SUMMARY OF THE INVENTION

One aspect of the invention is a dispenser for dispensing a single object at a time from a supply of objects. The dispenser includes a reservoir, an opening in the reservoir, a chute, a movable dispensing guide, and an actuator.

The reservoir is sized to contain a supply of objects. The opening in the reservoir is configured so the objects can be dispensed through the opening.

The chute is defined by a wall adjacent to the opening in the reservoir. The chute defines a dispensing path including first and second object positions. The first object position is adjacent to the opening in the reservoir. The second object position is adjacent to the first object position, and is more distant from the opening in the reservoir than is the first object position.

The movable dispensing guide has at least two positions: a retracted position and an advanced position. The retracted position does not prevent the progress of objects along the dispensing path. The advanced position intersects the dispensing path between the opening of the reservoir and the second object position. The movable dispensing guide in its advanced position prevents an object in the second object position from being further advanced along the dispensing path. The movable dispensing guide in its advanced position does not, however, interfere with dispensing an object from the first object position. The actuator is operable to move the movable dispensing guide from its retracted position to its advanced position.

BRIEF DESCRIPTION OF SEVERAL VIEWS OF THE DRAWINGS

The following reference characters are used in the drawing figures. Like numbers in the respective figures indicate like or comparable parts.

10 Dispenser
12 Primary Lid
14 Primary Container Body
16 Hinges
18 Flexible Diaphragm
20 Dispensing Orifice
22 Discrete Object
24 Discrete Object
26 Reservoir
28 Opening (in 26)
30 Chute
32 Movable Dispensing Guide
34 Actuator
35 Internal Spring
36 Wall (of 30)
38 Wall (of 30)
39 Dispensing Path
40 First Object Position
42 Second Object Position
44 Retracted Position (of 32)
46 Advanced Position (of 32)
50 Door
52 Closed Position (of 50)
54 Open Position (of 50)
56 Spring Arm
60 Door Opener
61 Recess (of 34)
62 Push Button (of 60)
64 Linkage (between 50, 62)
66 Door Link (of 60)
68 Door Pivot
70 Door Attachment Point
76 Guide Link
78 Guide Pivot
80 Guide Attachment Point
82 Guide Distal Portion
84 Guide Cam Following Surface
86 Inside Bearing Surface (of 88)
88 Return Leg Opening Wedge
90 Outside Bearing surface (of 88)
92 Spring Bearing Surface
94 Spring Leg
96 Recess (of 34)
100 Recess (of 78)
102 Barrel (of 34)
104 First Thread (of 102)
106 Skirt (of 62)
108 Center Post
110 Second Thread
111 Spring Stop
112 Stop
116 Base (of 26)
118 Upstanding Wall (of 20)

Figure 8:
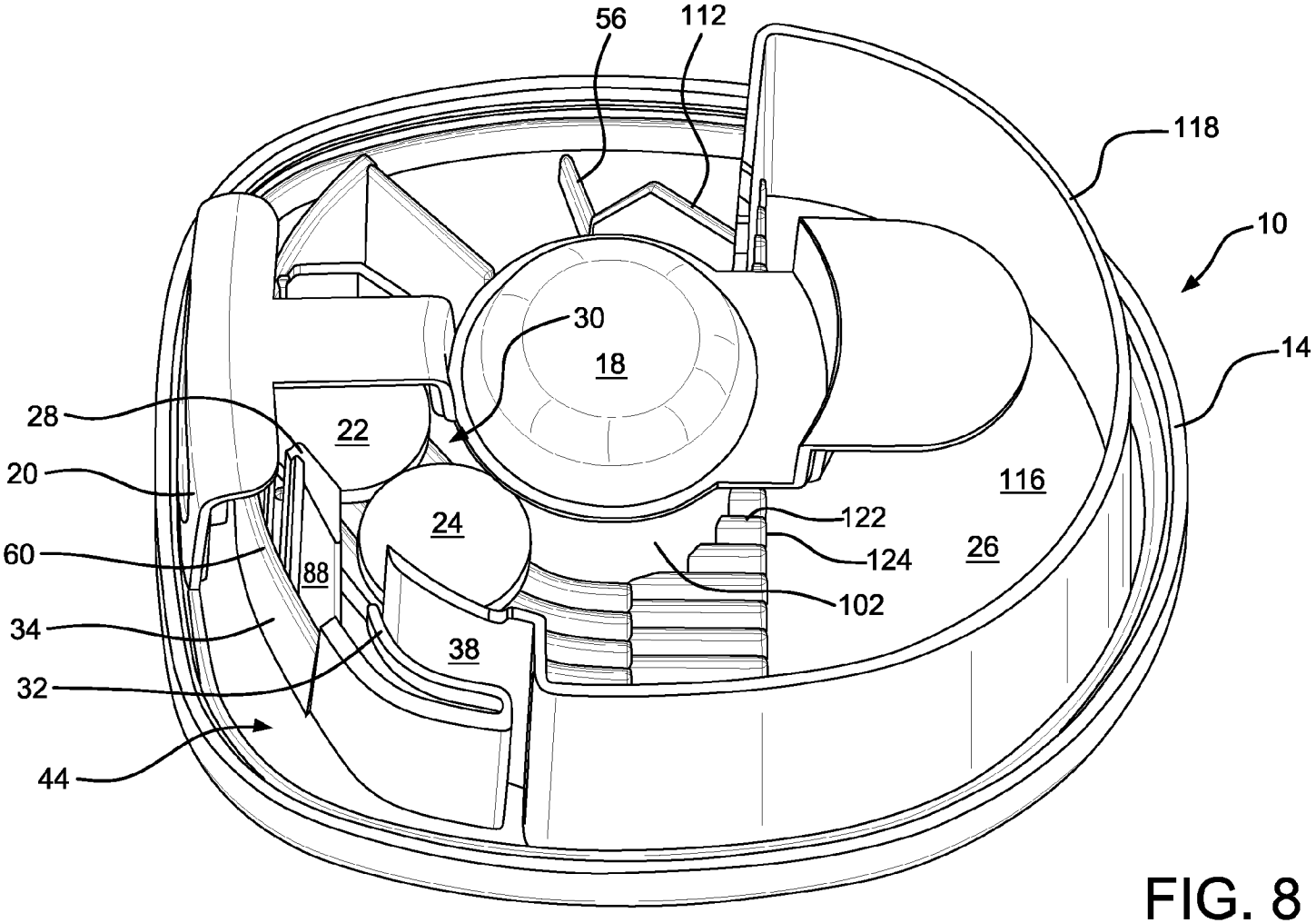
FIG. 8 is a view similar to FIG. 2 with the primary container body removed to show underlying structure.
Figure 9:
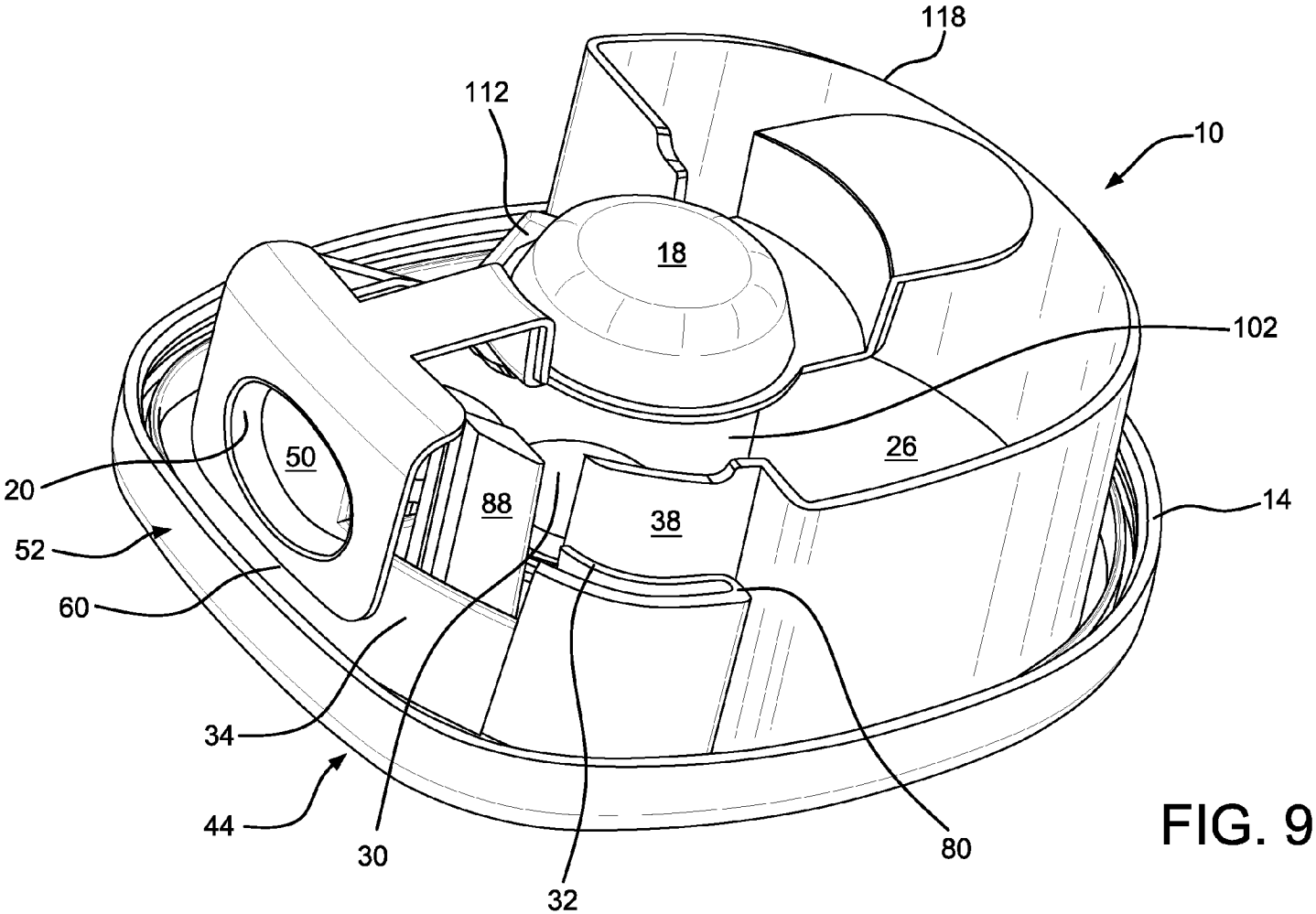
FIG. 9 is a view similar to FIG. 8, viewed at a different orientation.

120 Head (of 62)
122 Projecting Edge (of 124)
124 Rib
130 Dispenser (FIGS. 8-9)
132 Push Button
134 Door
136 Object

DETAILED DESCRIPTION OF THE INVENTION

The following detailed description of an illustrated embodiment and variations is only illustrative of the many embodiments of the invention within the scope of one or more of the claims. The inventors do not intend to limit the scope of the claims by reference to specific embodiments, unless done expressly.

Figure 1:
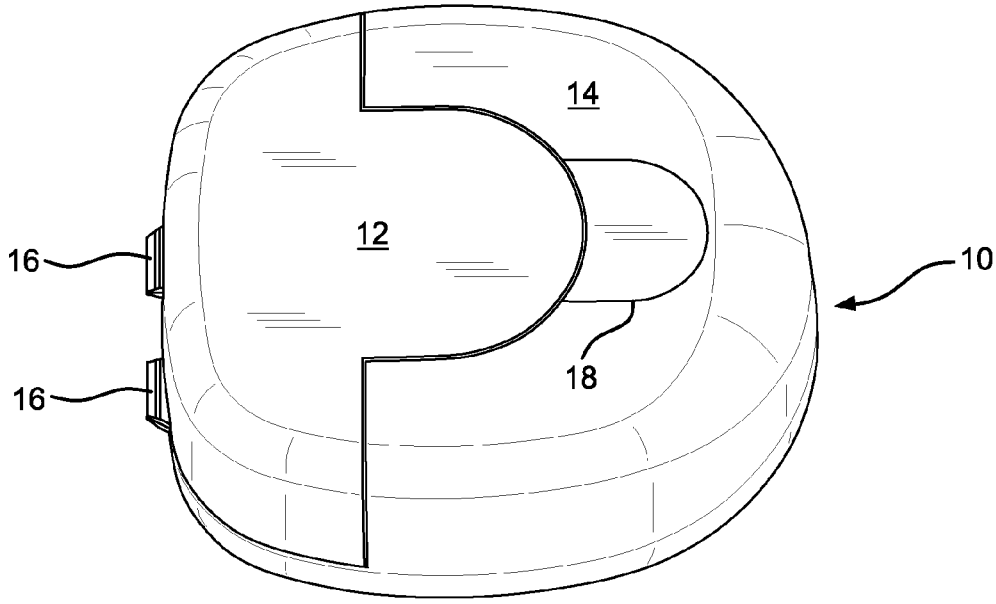
FIG. 1 is a perspective view of an embodiment of the disclosed dispensers.
Figure 2:
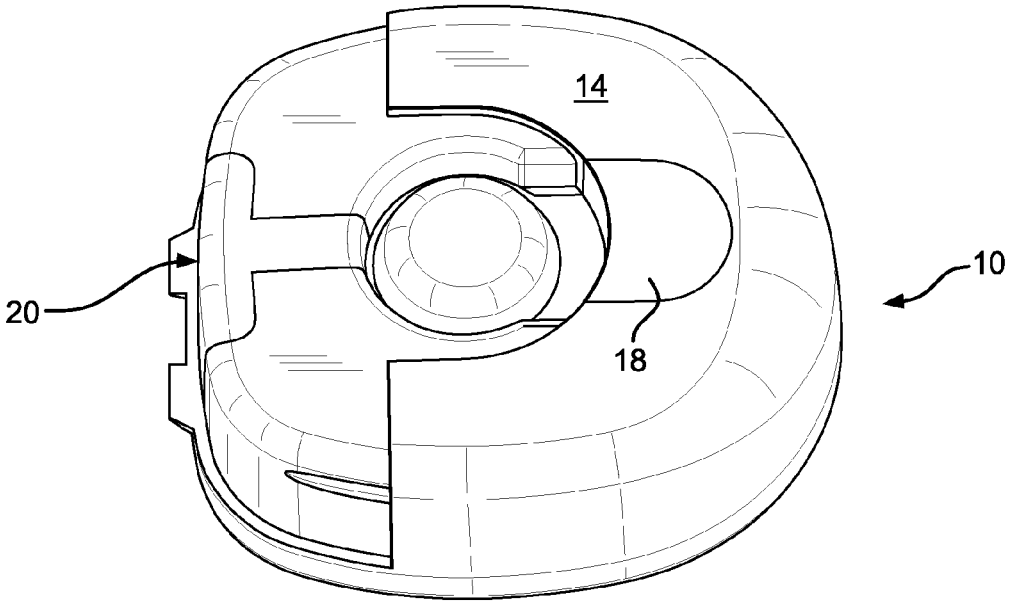
FIG. 2 is a view similar to FIG. 1, with the primary cover removed to show underlying structure.

Referring to the drawing figures, an embodiment of a dispenser 10 is shown. Referring to FIGS. 1 and 2, the dispenser 10 as illustrated includes a primary lid 12 and a primary container body 14 joined by primary hinges 16, which may be, for example, integral hinges. The dispenser 10 has a flexible diaphragm 18 covering the dispensing mechanism. (The mechanism is described in detail below.) The dispenser 10 has a dispensing orifice 20.

Figure 3:
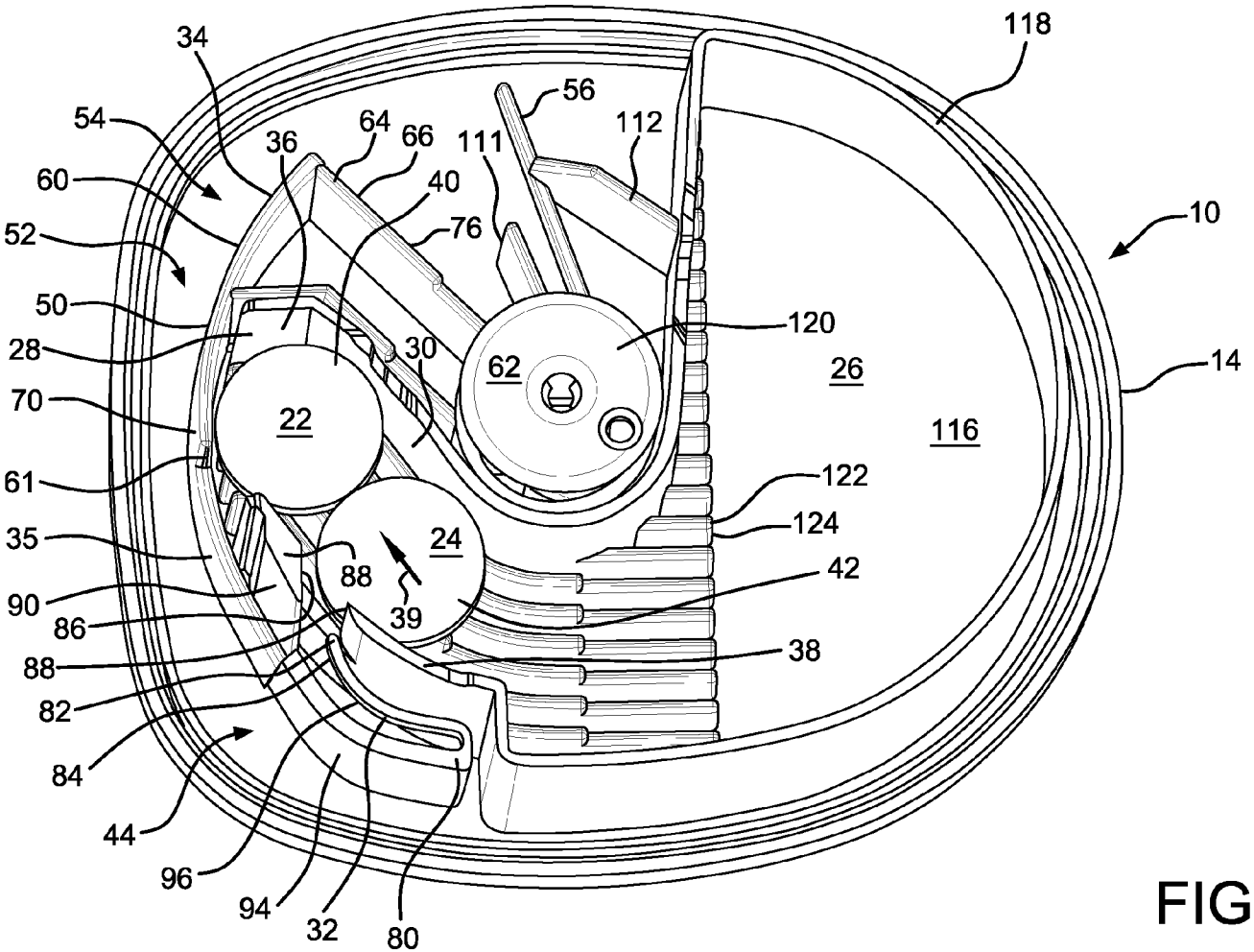
FIG. 3 is a view similar to FIG. 1, cut away to reveal the internal structure.
Figure 4:
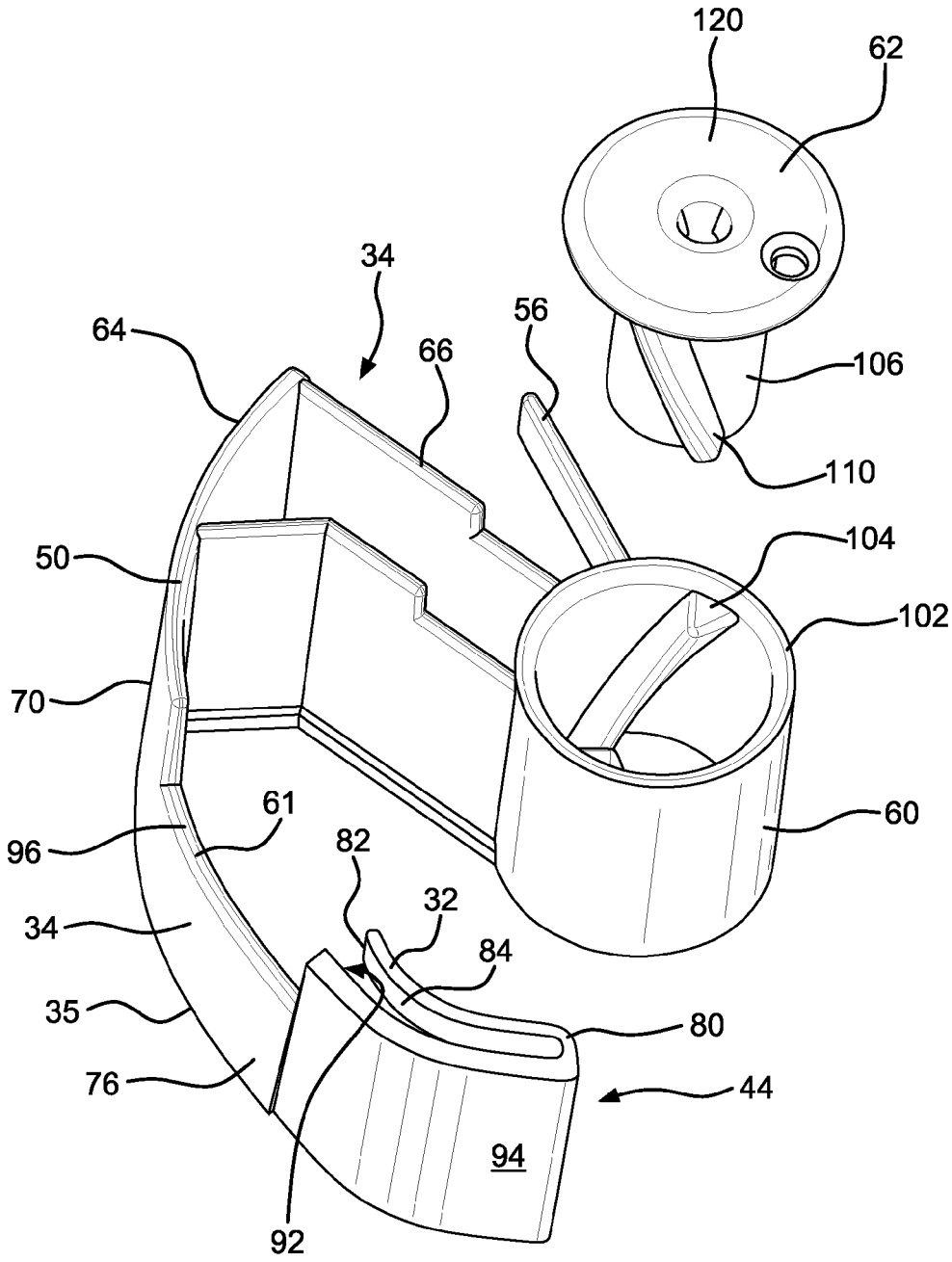
FIG. 4 is an isolated, exploded view of the pushbutton mechanism shown in FIG. 3.
Figure 5:
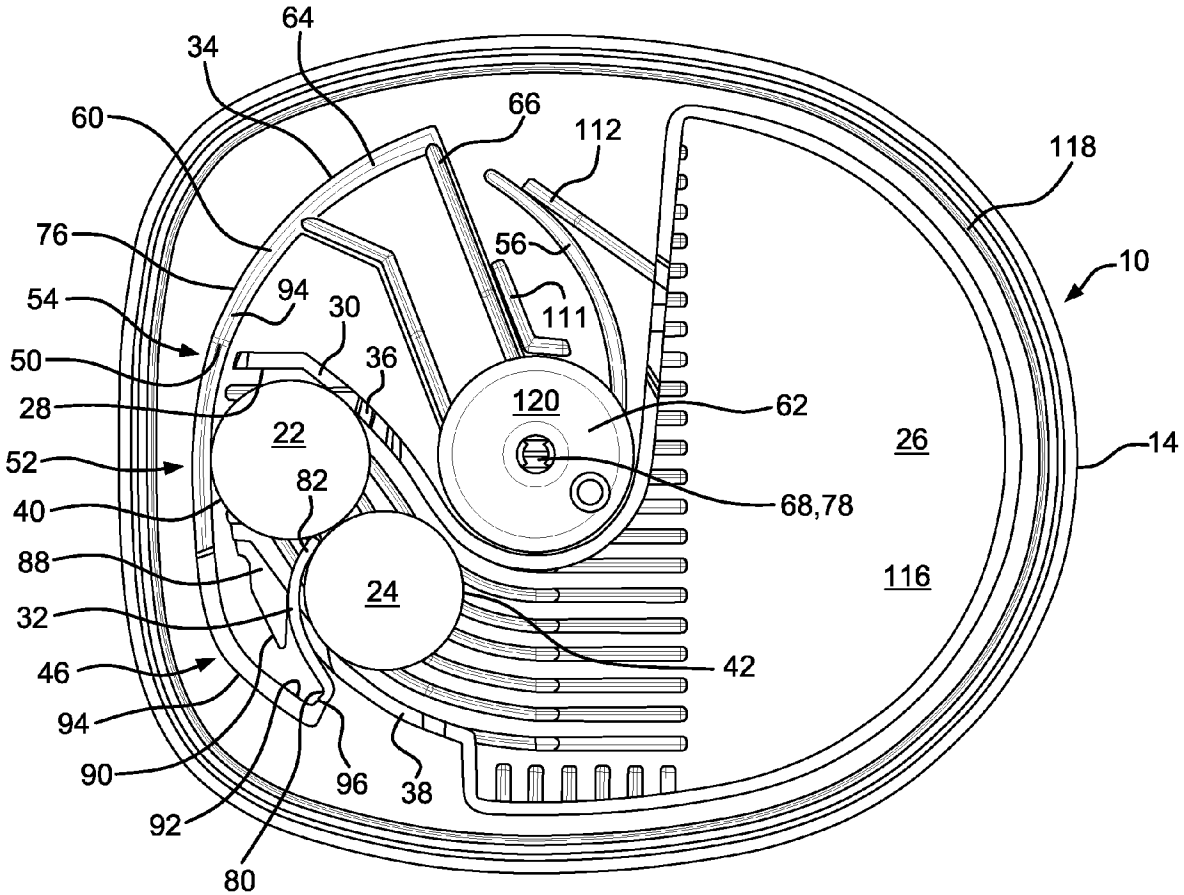
FIG. 5 is a view similar to FIG. 3.
Figure 6:
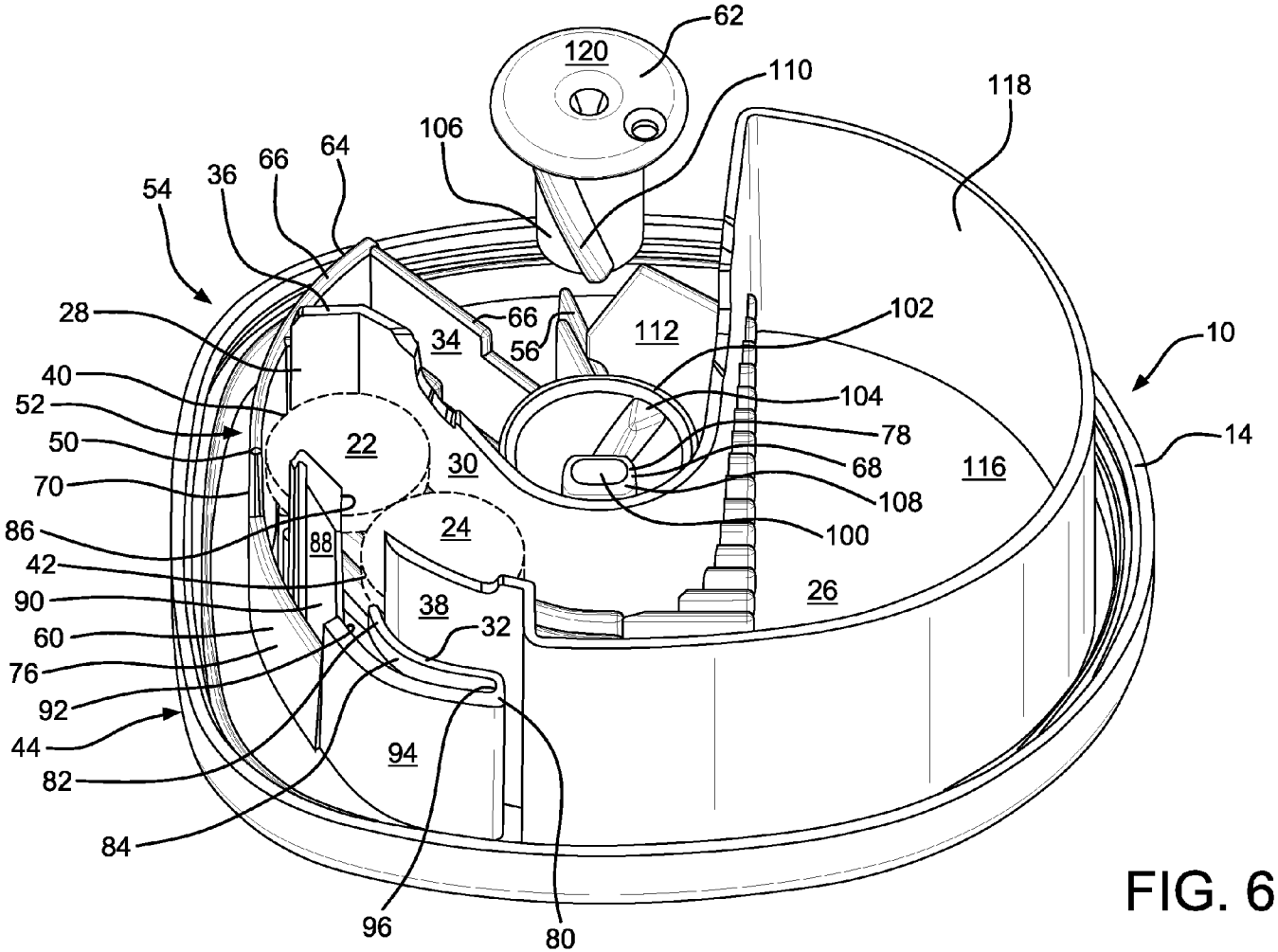
FIG. 6 is an exploded view similar to FIG. 3.
Figure 7:
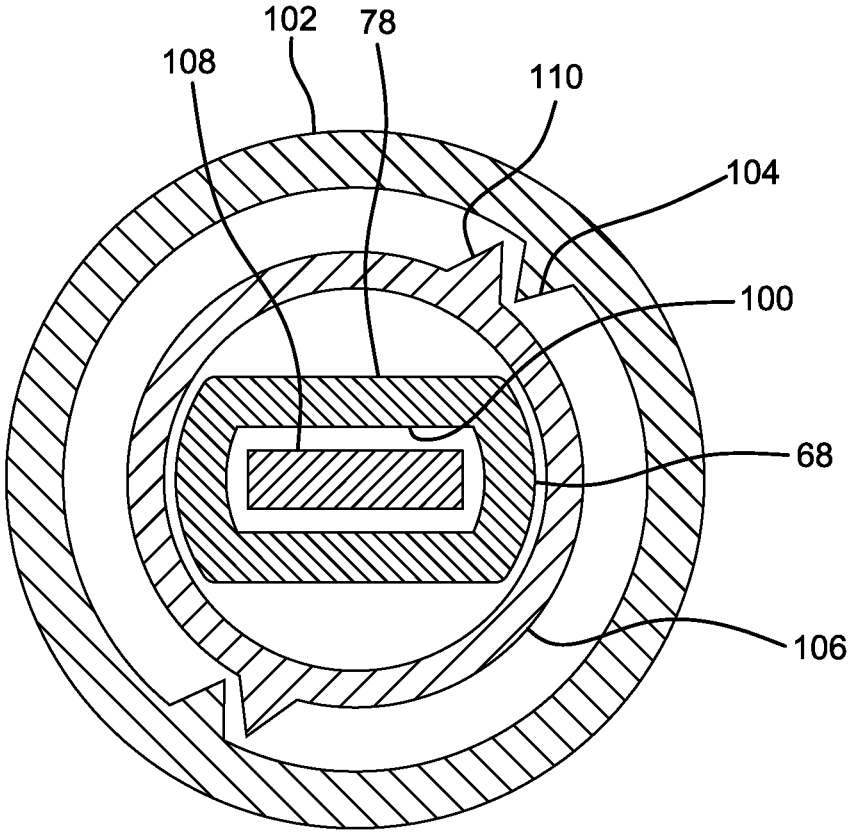
FIG. 7 is a cross-sectional view of the pushbutton and barrel assembly of FIG. 3.

Referring to FIGS. 3-5, the dispenser 10 can be used for dispensing a single object such as 22 at a time from a supply of objects such as 22 and 24. Some examples of objects are tablets, capsules, suppositories, candy pieces, game pieces (such as marbles), natural materials such as grain, raisins, or rock salt; mechanical parts such as BBs or pellets; etc. The nature and uses of the objects are not limited in any way. A tablet is used in this specification for illustrative purposes, but the objects dispensed are not limited to tablets.

The internal construction of the dispenser 10, shown in FIGS. 3-5, includes a reservoir 26, an opening 28 in the reservoir 26, a chute 30, a movable dispensing guide 32, and an actuator 34 including an internal spring 35.

The reservoir 26 is sized to contain a supply of tablets such as 22 and 24. The opening 28 in the reservoir 26 is configured so the tablets 22 and 24 can be dispensed through the opening 28.

The chute 30 is defined by an inner wall 36 and an outer wall 38 adjacent to the opening 28 in the reservoir 26. The chute 30 defines a dispensing path 39 including first and second object positions 40 and 42 that are, respectively, the positions occupied by the first and second tablets 22 and 24. The first object position 40 is adjacent to the opening 28 in the reservoir 26. The second object position 42 is adjacent to the first object position 40, and is more distant from the opening 28 in the reservoir 26 than is the first object position 40.

The movable dispensing guide or spring return leg 32 has at least two positions: a retracted position 44 as shown in FIGS. 3 and 4 and an advanced position 46 as shown in FIG. 5. The retracted position 44 does not prevent the advance of tablets such as 22 and 24 along the dispensing path 39. The advanced position 46 intersects the dispensing path 39 between the opening 28 of the reservoir 26 and the second object position 42. The movable dispensing guide 32 in its advanced position 46 prevents a tablet 24 in the second object position 42 from being further advanced along the dispensing path 39. The movable dispensing guide 32 in its advanced position 46 does not, however, interfere with dispensing a tablet 22 from the first object position 40. The actuator 34 is operable to move the movable dispensing guide 32 from its retracted position 44 to its advanced position 46.

The dispenser 10 includes a door 50 having a closed position 52 obstructing the opening 28 in the reservoir 26 to prevent a tablet such as 22 from being dispensed through the opening 28 in the reservoir 26 and an open position 54 permitting a tablet 22 to be dispensed through the recess or opening 28 in the reservoir 26. A spring such as the resilient spring lever arm 56 is provided for biasing the door 50 from its open position 54 toward its closed position 52. The dispenser 10 has a door opener indicated as 60. The door opener 60 is adapted for moving the door 50 to its open position aligning the recess 61 of the actuator 34 with the recess 28 in the reservoir 26.

The door opener 60 includes a push button 62 and a linkage 64 between the door 50 and the push button 62 for opening the door 50 when the push button 62 is pushed. More particularly, the door opener 60 comprises a door link 66 mounted for rotation about a door pivot defined by the post 68. The door link 66 has a door attachment point 70, shown here as spaced radially with respect to the door pivot 68, and the door 50 is connected to the door attachment point 70, such that rotation of the door link 66 about the door pivot 68 moves the door 50 between its closed and open positions, respectively shown in FIGS. 3 and 5.

In the present specification, an indication of "radial" spacing or movement includes radial spacing or movement that is also circumferential or axial to any degree. Similarly, an indication of "circumferential" or "axial" spacing or movement, or spacing or movement in any other direction, includes spacing or movement that is in the indicated direction, but is also in another direction to any degree.

As mentioned briefly before, the dispenser 10 also has a dispensing guide actuator 34 for moving the movable dispensing guide 32 between its retracted position 44 and its advanced position 46. In this embodiment, the dispensing guide actuator 34 and door opener 60 are the same mechanism, to which both the dispensing guide 32 and the door 50 are attached. In other contemplated embodiments, partially or completely separate mechanisms can be provided as the dispensing guide actuator 34 and door opener 60.

The dispensing guide actuator 34 comprises a guide link 76 mounted for rotation about a guide pivot 78. The guide link 76 has a guide attachment point 80 spaced radially with respect to the guide pivot 78, and the movable dispensing guide 32 is connected to the guide attachment point 80. Rotation of the guide link 76 about the guide pivot 78 moves the guide attachment point 80 circumferentially between its retracted position 44 and advanced position 46, respectively shown in FIGS. 3 and 5.

The movable dispensing guide 32 of this embodiment, also known as a return leg, has a guide distal portion 82 circumferentially spaced from the guide attachment point 80 when the movable dispensing guide 32 is in its retracted position 44 and a guide cam following surface 84 extending at least part of the length from the guide distal portion 82 to the guide attachment point 80.

Figure 10:
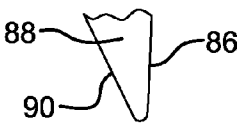
FIG. 10 is a detailed fragmentary plan view of the return leg opening wedge 88.

The guide cam following surface 84 of this embodiment bears against and slides along the guide cam surface or inside bearing surface 86 of a return leg opening wedge 88, as shown in FIGS. 5 and 10, for example. The wedge 88 is fixed to the container 10 and positioned to be contacted and followed by the guide cam following surface 84 when the movable dispensing guide 32 is moved toward or away from its advanced position 46 relative to the guide cam surface 86.

The movable dispensing guide 32 can be made of flexible material such as a thermoplastic. The flexible dispensing guide 32 bends as it advances, thus deflecting the guide distal portion 82 into intersection with the dispensing path 39. Projecting the guide distal portion 82 radially inward across the dispensing path 39 and/or into contact with the tablet 22 in the first object position 40 also blocks the movement of the second tablet 24, in the second object position 42, toward the dispensing orifice 20 and opening 28.

Optionally, a spring bearing surface 92 of the spring leg 94 also defines a cam following surface that bears against and slides along the outside bearing surface 90 of the opening wedge 88 when the movable dispensing guide 32 is moved toward or away from the advanced position shown in FIG. 5. In this optional embodiment, the return leg opening wedge 88 is forced into, and opens up, the recess 96 of the actuator 34 as the movable dispensing guide 32 advances. The fixed position and dual bearing surfaces 86 and 90 of the wedge 88 can work together to define the deflection path traveled by the guide distal portion 82 precisely and reproducibly.

In the embodiment of FIGS. 1-10, the actuator 34 defines a first leg and the movable dispensing guide 32 defines a second leg of a generally U-shaped member having a recess 96 extending between the first and second legs 34 and 32. The wedge 88 is positioned to enter the recess 96 opening between the legs 34 and 32 and deflect the movable dispensing guide 32 across the dispensing path 39 when the movable dispensing guide 32 is moved toward its advanced position 46.

The movement of the door 50 and movable dispensing guide 32 is driven by rotating the guide link 76 about the guide pivot 78 using a push button 62, as explained above and in more detail below.

The guide pivot 78 is a post fixed with respect to the dispenser 10 to prevent the guide pivot 78 from rotating. The guide pivot 78 establishes the pivot axis. The guide pivot 78 has an internal non-round recess 100. ("Non-round" is broadly defined here to include two or more eccentric, circle-section recesses, as well as a single recess that does not have a circular section.)

The actuator 34, shown in isolation in FIG. 4, has a barrel 102 that is fixed relative to the guide link 76, so they will rotate together about the guide pivot 78. The barrel 102 supports one or more first screw threads such as 104.

The push button 62 has a depending skirt or actuator screw 106 and a depending non-round concentric center post 108. The skirt 106 supports one or more external second threads such as 110. The center post 108 of the push button 62 fits into the recess 100 of the guide pivot 78, so the barrel 102 and the skirt 106 can telescope together. The center post 108 is non-round and complementary with the recess 100. When the center post 108 is inserted into the recess 100, the center post 108, and thus the push button 62, can move axially with respect to the recess 100 in telescoping relation, but cannot rotate substantially relative to the recess 100.

The first and second screw threads 104 and 110 are concentric, mating, and engaged. The first thread 104 is fixed relative to the guide link 76 and rotatable about the guide pivot 78. The second thread 110 is movable relative to the guide link 76 (in this case, axially movable), but prevented from rotating about the guide pivot 78. The guide link 76 is rotated about the guide pivot 78 by moving the second thread 110 and the first curved thread 104 axially together, as by depressing the push button 62. Axial translation of the push button 62 is converted by engagement of the first and second curved threads 104 and 110 to rotary motion of the barrel 102 and corresponding rotary motion of the rest of the actuator 34 about the pivot 78. Rotation of the actuator 34 is limited by the spring stop 111 fixed to the dispenser 10.

As the push button 62 is depressed and the guide link 76 rotates clockwise as shown in the Figures, the spring lever arm 56 bears against a lever arm stop 112 that is fixed with respect to the dispenser 10. As illustrated in FIG. 5, when the guide link 76 is rotated to its advanced position, the spring lever arm 56, which is resilient, is an activated spring bent against the lever arm stop 112, and exerts a counterclockwise counterforce on the guide link 76. When the push button 62 is released, this counterforce returns the guide link 76 and the push button 62 to their rest positions.

In operation, the dispenser 10 functions as follows to dispense one tablet at a time. The chute 30 is loaded with tablets such as 22 and 24, as by tipping or shaking the dispenser 10 while the door 50 is closed, so gravity can direct the tablets 22 and 24 into the first and second object positions 40 and 42, but the path through the openings 28 and 20 is blocked. The push button 62 is then depressed, moving the movable dispensing guide 32 to its advanced position 46 where it is adjacent to, and optionally intersects, the back of the first object position 40. The advanced position of the movable dispensing guide 32 is also forward of, and blocks travel along the dispensing path of, a tablet such as 24 in the second object position 42. At the same time, the door 50 is opened, releasing the first tablet 22 through the openings 20 and 28.

Optionally, the movable dispensing guide 32 can be adapted to perform the further function of pushing a movable tablet such as 22 from the first object position 40 toward the opening 28 when the movable dispensing guide 32 is advanced from its retracted position 44 toward its advanced position 46. In other words, the guide distal portion 82 can be adapted to touch the tablet 22 at the first object position 40 before the dispensing guide 32 is fully advanced, so further advancing the dispensing guide 32 into intersection with the back of the first object position 40 (i.e. the side away from the opening 28) displaces the tablet 22 toward the opening 28, providing a positive dispensing force.

After the first tablet 22 is dispensed, the push button 62 is released and the movable dispensing guide 32 returns to its retracted position 44. In its retracted position, the movable dispensing guide 32 does not intersect with the first object position or block the path of the second movable tablet 24. When the chute 30 is again loaded as described above, the second tablet 24 is free to advance to the first object position 40 adjacent to the opening 28 until it is stopped by the closed door 50, and an additional tablet or other object is able to move into the second object position 42 (assuming more than one tablet remains in the dispenser).

Figure 11:
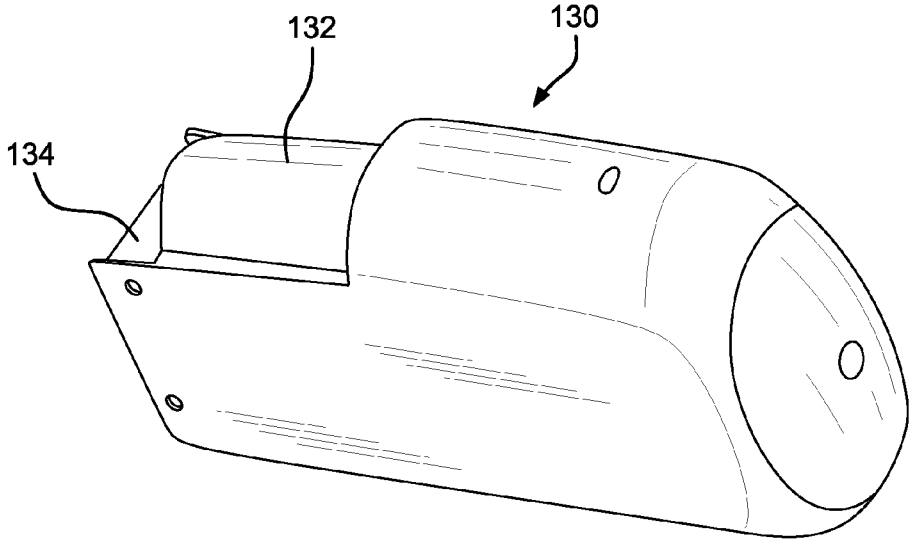
FIGS. 11 and 12 are perspective views of an alternative embodiment of the invention.
Figure 12:
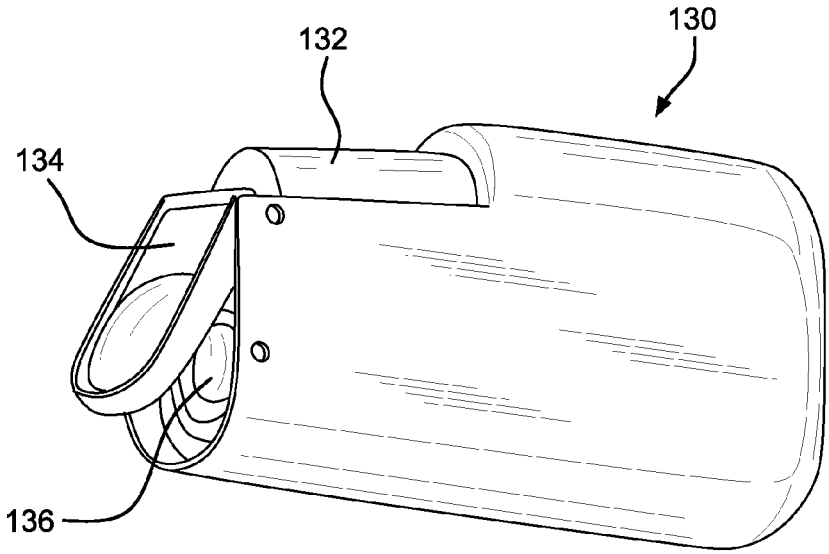

Another embodiment of the dispenser is shown in FIGS. 11 and 12. The dispenser 130 comprises a push button 132, a door 134, and an object 136 in the first object position. In this embodiment, the external configuration is different. Also, the door 134 is a swinging door instead of a sliding door. Mechanical expedients to swing a door open and shut are well known, and are contemplated for use with this embodiment.

The dispensing mechanisms of the dispensers 10 or 130 can have as few as three parts—the actuator 34, the push button 62, and the reservoir 26 and other fixed portions of the case 14. The actuator 34 can be made as one injection molded part in a linearly parting two part mold. The fixed interior details of the case 14, such as the base 116, the upstanding wall 118, the lever arm stop 112, the pivot 78, and the wedge 88 of the dispenser 10, similarly can be made as one injection molded part in a linearly-parting two-part mold. The push button 62 can be made in a two-part mold as well, although the portion forming the threaded skirt 106 may need to be formed by a helically withdrawn mold portion if the head 120 of the push button 62 defines an overhang over the curved threads, and vice versa, as illustrated in the Figures. The head 120 could also be a separate part that is snapped into place on the skirt 106, after molding them separately.

In various embodiments, the guide link 76 and door link 66 can be integral, which can mean either that they are joined together into one piece or formed as one piece in any known manner, such as by injection molding, lost-wax casting, machining, or powder fabrication. Thus, as in the illustrated embodiment, the door 50 and movable dispensing guide 32 can be integral. The guide link 76 and movable dispensing guide 32 can be integral. The door 50 and door link 66 can be integral. All of these parts can be integral, as in the illustrated embodiment.

Another feature shown by the Figures is a false floor in the vicinity of the chute 30, defined by the projecting edges such as 122 of upstanding ribs such as 124 on the base 116 of the reservoir 26. This false floor prevents stacking of two or more tablets such as 22 or 24 in the chute 30, which might cause more than one tablet to be dispensed at a given time. The reservoir 26 could instead be made shallower in other ways, either overall or in the vicinity of the chute 30, to accomplish the same effect, but would hold fewer tablets outside the chute 30 if the entire reservoir were shallower. Another purpose for the ribs such as 124 can be to increase the surface area of the reservoir walls, which is particularly useful if the ribs such as 124 are made of a desiccant material, oxygen scavenger material, or another functional material as described in the patents incorporated by reference below.

Many other alternatives to the illustrated embodiments, and the objects such as 22 and 24, are contemplated. The objects can be identical, such as a series of tablets molded in the same mold, or varied somewhat in size or shape, as by providing objects screened to have similar sizes, but not necessarily identical sizes or shapes.

The dispenser 10 can optionally have any or all of the following features, in any combination or arrangement.

The package optionally can dispense one tablet at a time.

A downward depression on an actuation button optionally can cause a rotational movement on an internal spring, which optionally can allow only one tablet at a time to be dispensed.

The package optionally can be moisture tight, as described in one or more of U.S. Pat. Nos. 7,243,817; 7,213,720; 7,005,459; 6,726,058; 6,613,405; and 6,486,231, which are hereby incorporated here by reference in their entireties.

The package optionally can have the ability to accommodate desiccant plastic, as described in one or more of U.S. Pat. Nos. 7,243,817; 7,213,720; 7,063,234; 7,005,459; 6,726,058; 6,705,463; 6,613,405; 6,486,231; or 6,465,532; which are hereby incorporated here by reference in their entireties.

The package optionally can have the ability to accommodate three phase polymers, as described in one or more of U.S. Pat. Nos. 7,005,459; 6,852,783; 6,613,405; 6,486,231; 6,465,532; or 6,460,271; which are hereby incorporated here by reference in their entireties.

The package optionally can have the ability to accommodate specialty films such as oxygen scavenging films, as described in one or more of U.S. Pat. Nos. 7,258,930; 7,258,882; 7,153,891; 7,022,258; 6,960,376; 6,942,821; 6,911,122; 6,689,438; 6,682,791; 6,632,408; 6,610,215; 6,599,598; 6,599,487; 6,586,514; 6,569,506; 6,464,896; 6,449,923; 6,406,644; 6,369,148; 6,333,087; 6,287,481; 6,259,107; 6,254,802; 6,233,907; 5,911,910; 5,904,960; 5,885,481; 5,811,027; 5,744,056; 5,741,385; and 5,112,449; which are hereby incorporated here by reference in their entireties.

The package configurations shown can be described as square or rectangular parallelepipeds with rounded corners and edges, or low-profile cylinders with somewhat flattened sides. The internal spring mechanism, however, can be easily applied to other external configurations.

The design configuration could have a child-resistant and senior-friendly ("CRSF") closure (i.e. difficult for a young child to open but easy for a senior citizen to open), as described in various patents and patent applications, such as one or more of U.S. Pat. Nos. 7,222,754; 7,070,069; 6,976,576; 6,202,869; 6,029,858; 5,819,967; and 5,718,347; and U.S. Patent Application Publ. Nos. 20070251983; 20070246395; 20070170191; 20070084747; 20070068844; 20070068843; 20070054525; 20070045149; 20070034543; 20050274644; and 20040226853; which are hereby incorporated here by reference in their entireties.

In an alternative arrangement, not illustrated, the actuator 34 could be provided as a slide, which could be straight, instead of the curved circumferentially extending link shown in FIG. 4. The slide could be shuttled in its plane, as by manipulating a handle on one or both ends, to open and close the door 50, operate the movable dispensing guide 32, or both. Additionally, any other mechanisms that can carry out one or more functions as described in this specification are contemplated for use.

What is claimed is:

1. A dispenser for dispensing a single object at a time from a supply of objects, the dispenser comprising:

A. a reservoir sized to contain a supply of objects;

B. an opening in the reservoir, through which objects can be dispensed;

C. a chute defined by a wall adjacent to the opening in the reservoir, the chute defining a dispensing path comprising a first object position adjacent to the opening and a second object position that is adjacent to the first object position and is more distant from the opening than the first object position;

D. a movable dispensing guide having:

a retracted position that does not prevent the advance of objects along the dispensing path, and an advanced position that intersects the dispensing path between the opening of the reservoir and the second object position to prevent an object in the second object position from being further advanced along the dispensing path without interfering with dispensing an object from the first object position; and E. a dispensing guide actuator for moving the movable dispensing guide between its retracted and advanced positions, wherein the dispensing guide actuator comprises a guide link mounted for rotation about a guide pivot, the guide link has a guide attachment point spaced radially with respect to the guide pivot, and the movable dispensing guide is connected to the guide attachment point, such that rotation of the guide link about the guide pivot moves the guide attachment point circumferentially between its retracted and advanced positions.

2. The dispenser of claim 1, further comprising a door having a closed position obstructing the opening in the reservoir to prevent an object from being dispensed through the opening in the reservoir and an open position permitting an object to be dispensed through the opening in the reservoir.

3. The dispenser of claim 2, further comprising a spring biasing the door from its open position toward its closed position.

4. The dispenser of claim 2, further comprising a door opener adapted for moving the door to its open position.

5. The dispenser of claim 4, wherein the door opener comprises a push button and a linkage between the door and the push button for opening the door when the push button is pushed.

6. The dispenser of claim 4, wherein the door opener comprises a door link mounted for rotation about a door pivot, the door link has a door attachment point spaced radially with respect to the pivot, and the door is connected to the door attachment point, such that rotation of the door link about the door pivot moves the door between its closed and open positions.

7. The dispenser of claim 1, wherein the advanced position of the movable dispensing guide intersects with the first object position and the retracted position of the movable dispensing guide does not intersect with the first object position.

8. The dispenser of claim 1, wherein the movable dispensing guide is adapted to push an object from the first object position toward the opening when the movable dispensing guide is moved toward its advanced position.

9. The dispenser of claim 1, wherein the dispensing guide actuator defines a first leg and the movable dispensing guide defines a second leg of a generally U-shaped member having a recess extending between the first and second legs.

10. The dispenser of claim 9, further comprising a wedge positioned to enter the recess opening between the legs and deflect the movable dispensing guide across the dispensing path when the movable dispensing guide is moved toward its advanced position.

11. The dispenser of claim 1, wherein the movable dispensing guide has a guide distal portion spaced from the guide attachment point when the movable dispensing guide is in its retracted position and a guide cam following surface extending at least part of the length from the guide pivot to the guide distal portion.

12. The dispenser of claim 11, further comprising a guide cam surface positioned to be contacted and followed by the guide cam following surface when the movable dispensing guide is moved toward its advanced position relative to the guide cam surface, thus deflecting the guide distal portion into intersection with the dispensing path.

13. The dispenser of claim 1, further comprising first and second mating, engaged screw threads having concentric axes, the first thread being fixed relative to the guide link and the second thread being movable relative to the guide link, wherein the guide link is rotated about the guide pivot by moving the second thread and the first thread axially together.

14. The dispenser of claim 6, wherein the guide link and door link are integral.

15. The dispenser of claim 2, wherein the door and movable dispensing guide are integral.

16. The dispenser of claim 1, wherein the guide link and movable dispensing guide are integral.

17. The dispenser of claim 6, wherein the door and door link are integral.

18. The dispenser of claim 1, wherein the objects comprise tablets, capsules, or suppositories.

19. The dispenser of claim 1, wherein the objects comprise tablets.

* * * * *